US006282725B1

(12) United States Patent
Vanidestine, Jr.

(10) Patent No.: US 6,282,725 B1
(45) Date of Patent: Sep. 4, 2001

(54) DISPOSABLE, REMOVABLE SANITARY DECORATIVE STRAP COVER

(76) Inventor: Thomas J. Vanidestine, Jr., 1822 Ohio St., Bangor, ME (US) 04401

( * ) Notice: Subject to any disclaimer, the term of this patent is extended or adjusted under 35 U.S.C. 154(b) by 0 days.

(21) Appl. No.: 09/596,342

(22) Filed: Jun. 19, 2000

Related U.S. Application Data

(63) Continuation-in-part of application No. 09/089,083, filed on Jun. 2, 1998, now abandoned.
(60) Provisional application No. 60/070,008, filed on Dec. 30, 1997.

(51) Int. Cl.[7] ..... A42B 7/00
(52) U.S. Cl. ..... 2/421; 2/209.13
(58) Field of Search ..... 2/209.13, 421, 2/455, 460, 422, 425, 44, 415

(56) References Cited

U.S. PATENT DOCUMENTS 4,706,305 * 11/1987 Cho ..... 2/425
4,884,301 * 12/1989 Aileo ..... 2/421
5,287,559 * 2/1994 Christiansen et al. ..... 2/181
5,500,951 * 3/1996 Marchello ..... 2/2
5,546,605 * 8/1996 Mallardi ..... 2/209.13
5,687,425 * 11/1997 Blosser ..... 2/209.13
5,737,777 * 4/1998 Hilleary ..... 2/421
5,794,274 * 8/1998 Kraemer ..... 2/421
5,862,524 * 1/1999 Case ..... 2/209.13
5,890,232 * 4/1999 Park ..... 2/413

* cited by examiner

*Primary Examiner*—John J. Calvert
*Assistant Examiner*—Katherine Moran
(74) *Attorney, Agent, or Firm*—John D. Gugliotta

(57) ABSTRACT

A protective, sanitary, and decorative athletic helmet chin strap cover is disclosed wherein an elastic sleeve fits over a conventional athletic helmet chin strap, contouring therewith and elastically securing thereto. The cover displays a team name or logo via embroidering, silk screening, or other fabric marking methods.

5 Claims, 2 Drawing Sheets

DISPOSABLE, REMOVABLE SANITARY DECORATIVE STRAP COVER

RELATED APPLICATIONS

The present application is a Continuation in Part of U.S. Utility patent application Ser. No. 09/089,083, filed on Jun. 2, 1998 now abandoned, which was a continuation of Provisional Patent Application No. 60/070,008, titled Sanitary Decorative Cover for Athletic Helmet Chin Straps and filed on Dec. 30, 1997.

BACKGROUND OF THE INVENTION

1. Field of the Invention

The present invention relates generally to chin straps used to secure athletic helmets to the head of the wearer, and more specifically to a protective, sanitary, decorative chin strap sleeve that fits over and elastically attaches to a conventional athletic helmet chin strap.

2. Description of the Related Art

A search of the prior art did not disclose any patents that read directly on the claims of the instant invention, however several references, pertaining mainly to helmet chin straps and more specifically football helmet chin straps, were considered related:

U.S. Pat. No. 2,867,811 issued in the name of Jones, discloses an early design for a football helmet strap in which a chin support cup is attached to a single securing strap extending from each side of the support cup and attaching to the helmet via a snap button securing device. The chin support cup is fit with absorbent padding and is washable, however the user's skin remains exposed to the edges of the support cup, making it prone to causing cuts and abrasions upon impact. Also, maintaining a sanitary condition would necessarily entail complete replacement of the chin strap. Finally, the strap provides no decorative, promotional or advertising purpose.

Several patents disclose more conventional four-point football helmet chin straps wherein a chin support cup includes a pair of straps that connect to the helmet laterally, along the side of the helmet at chin-level and a pair of straps connect to the helmet in a mostly vertical manner, approximately at eye-level:

U.S. Pat. No. 3,166,761 issued in the name of Strohm;

U.S. Pat. No. 4,051,556 issued in the name of Davenport;

U.S. Pat. No. 4,062,068 issued in the name of Davenport et al.;

U.S. Pat. No. 4,646,368 issued in the name of Infusino et al.;

U.S. Pat. No. 4,651,356 issued in the name of Zide; and

U.S. Pat. No. 5,347,660 issued in the name of Zide et al.

The primary purposes of these devices is to secure the helmet to the head in a manner so as to minimize the movement thereof upon impact. These devices do take chin protection and comfort into consideration, although as a secondary concern, however, they do fail to protect the wearer from the cuts and abrasions commonly caused by contact between the rigid edges of the chin support cup and the wearer's chin upon impact. Furthermore, maintaining a sanitary chin condition is not an aim of these devices, therefore maintaining such a condition would necessarily entail complete replacement of the chin strap. Finally, the strap provides no decorative, promotional or advertising purpose.

While several features exhibited within these references are incorporated into this invention, alone and in combination with other elements, the present invention is sufficiently different so as to make it distinguishable over the prior art.

SUMMARY OF THE INVENTION

The sanitary decorative cover for athletic helmet chin straps is a tubular elastic cloth sleeve that fits over an athletic helmet chin strap, covering the cup-like chin-guard portion of the strap into which the wearer's chin rests. Designed to fit a variety of different types of helmets such as those worn by football and hockey players, the sleeves will include logos, team names and the like that serve as a decorative, promotional and advertising identifier. The chin strap serves to protect the wearer by providing additional padding as well as forming a barrier between the chin and the edges of the chin support cup that often causes cuts and abrasions upon impact. The chin strap cover also serves a sanitary purpose in the sense that, since chin injuries are quite frequent and bleeding often results, the cover isolates the chin from the strap. The cover is easily installed and removed and is completely submersible and washable.

It is therefore an object of the present invention to provide an athletic helmet chin strap cover that accommodates a variety of chin strap shapes and contours, and securably attaches thereto.

It is another object of the present invention to provide an athletic helmet chin strap cover that assumes the shape and contour of the chin strap so as not to compromise the helmet securing and stabilizing capabilities of the strap.

It is another object of the present invention to provide an athletic helmet chin strap cover that attaches to the chin strap by means of elastic construction, hook and loop fasteners, or mechanical snap-on fasteners.

It is another object of the present invention to provide an athletic helmet chin strap cover that provides additional padding, providing enhanced comfort and creating a barrier between the wearer's chin and the rigid edges of the chin support cup, thus preventing cuts and abrasions caused upon impact therewith.

It is another object of the present invention to provide an athletic helmet chin strap cover that provides a sanitary barrier between the wearer's chin and the chin strap or chin support cup.

It is another object of the present invention to provide an athletic helmet chin strap cover that is easily installed and removed and that is submersible and washable, allowing it to be maintained in a clean and sanitary condition.

It is another object of the present invention to provide an athletic helmet chin strap cover that displays a team name or logo in a prominent manner when attached to the chin strap.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
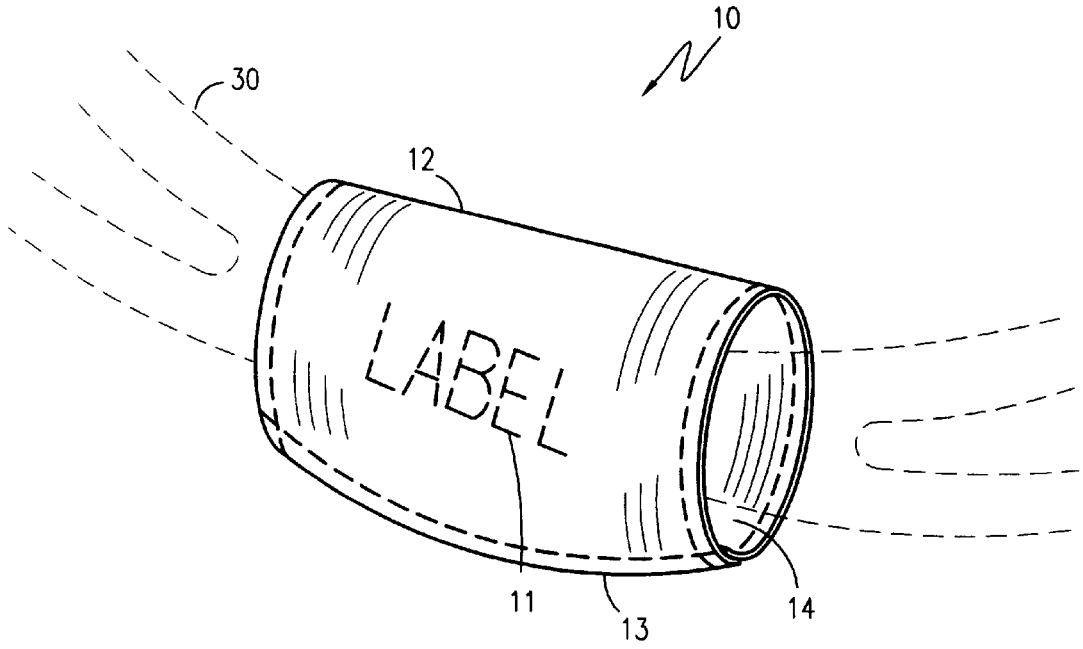
FIG. 1 is a front perspective view of the sanitary decorative cover for athletic helmet chin straps, according to the present invention.
Figure 2:
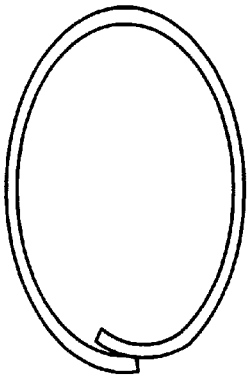
FIG. 2 is a side elevational view thereof.

Referring to FIG. 1 and FIG. 2, a sanitary decorative cover for athletic helmet chin straps, generally noted as 10 and generally referred to as chin strap cover is shown, according to the present invention. The chin strap cover 10 is generally elongated and tubular in shape. When formed, a relatively straight horizontal crown edge 12 is formed, and a lower extended, concave curvilinear basal edge 13 is formed opposite thereto. A hollow interior cavity 14 is thereby formed, with a cup receiving pouch 16 through which an athletic helmet chin strap 30 passes, as well as allowing the chin cup element (not shown) portion of the chin strap to reside down into the interior cavity 14. A labeling means is further provided for affixing an athletic team name or logo 11 prominently on the chin strap cover 10 via embroidery, silk-screening or other conventional method.

A variety of chin strap designs may be encountered, such as the single strap without a chin cup variety commonly found on hockey helmets (not shown.) However, these chin strap designs do not preclude the use of the present invention, as it designed to accommodate most conventional strap designs. Of general availability are two basic types of chin straps: a hard cup strap, and a soft cup strap. Generally, the hard cup strap variety is of a larger overall dimension; therefore, it is anticipated that the cup receiving pouch 16 would be particularly modified to accommodate this by extended farther downward over the size utilized to accommodate the soft cup strap variety.

Figure 3:
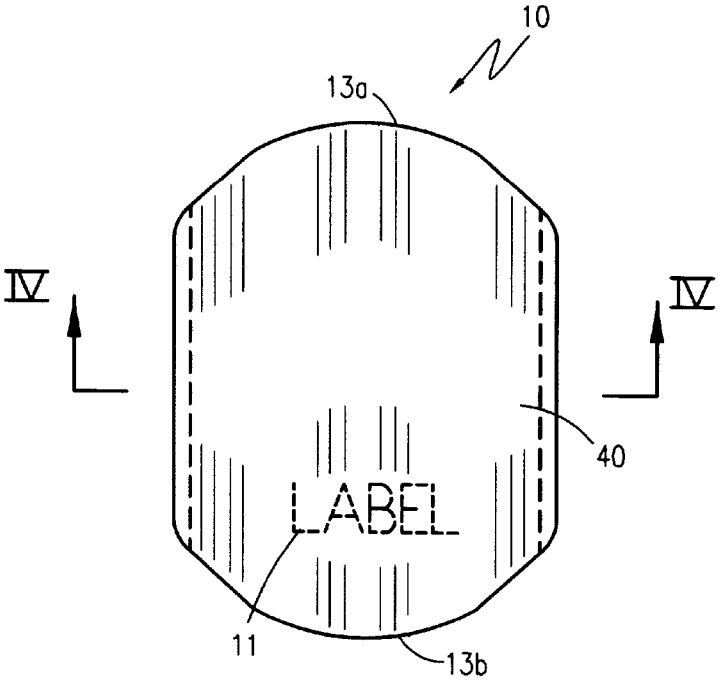
FIG. 3 is a top plan view of thereof shown in a flat, unassembled condition.

Referring now to FIG. 3, a top plan view of a flattened, unassembled sanitary decorative cover for athletic helmet chin straps 10 is shown. Particularly, the outer surface 40 having a smooth, linear first side 41*a* opposite a parallel, smooth, linear second side 41*b* a concave lower protrusion extending downward from the main planar surface at a lower boundary in a symmetric, curvilinear manner having an upward arching lowermost point that smoothly transitions at each end to a horizontal extension at each of the side-most portions of the lower perimeter in a symmetric, curvilinear manner, having an upward arching lowermost point that smoothly transitions to horizontal at each end.

Figure 4:
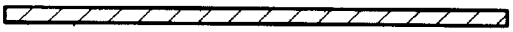
FIG. 4 is a cross sectional elevational view taken along line IV—IV of FIG. 3.

Referring now to FIG. 4, cross sectional elevational view is shown of the sanitary decorative cover for athletic helmet chin straps, according to the present invention. As shown, a first, outer layer 40 is planarly aligned with a second, inner layer 42. The outer layer 40 is anticipated as being formed of a porous fabric material having sufficient elasticity to accommodate the stretching of the decorative cover 10 over the chin strap 30. The inner layer 42 is anticipated as being aligning material, such a HYDROFIL™ nylon, or DRI-LEX™ such as manufactured by Faytex Corp., or functional equivalent. Such an inner layer 42 provides superior moisture wicking characteristic, as well as dirt release during cleaning and cushioning for the user's comfort. Also as indicated, the outer layer 40 extends outward from the sides of the inner layer 42 and wrapped about each end by a hem 44 and sealed by a seam 46.

2. Operation of the Preferred Embodiment

According to the preferred embodiment, the chin strap cover 10 slides over the chin strap 30 elastically forming to the contour of the chin support cup and the chin straps and securing thereto, elastically, constricting around the structure of the chin strap 30. As installed, the chin strap cover 10 serves to display and promote a team name or logo. Furthermore, the chin strap cover 10 serves a sanitary purpose in isolating the chin strap 15 from the helmet wearer's chin. This is especially useful in situations where several individuals share the same equipment and where the wearer suffers cuts or abrasions in the chin region. The physical properties of the clothe construction of the chin strap cover 10 also serves to enhance the padding of the chin support cup 16, providing a more comfortable fit. Furthermore, since the chin strap cover 10 wraps completely around the chin strap 30 and the chin support cup, padding is provided along the generally rigid edges of the chin support cup, thus preventing cuts and abrasions upon impact.

While the preferred embodiments of the invention have been shown, illustrated, and described, it will be apparent to those skilled in this field that various modifications may be made in these embodiments without departing from the spirit of the present invention. It can therefore be seen that the decorative and sanitary benefits taught herein can be broadly applied. It is for this reason that the scope of the invention is set forth in and is to be limited only by the following claims.

What is claimed is:

1. An athletic helmet chin strap cover, said chin strap cover comprising an elastic fabric sleeve, generally cylindrical in shape, forming a relatively straight horizontal crown edge and a lower extended, concave curvilinear basal edge opposite thereto, thereby forming a hollow interior cavity having with a cup receiving pouch for allowing a chin cup element portion of a chin strap to reside down into said hollow interior cavity, wherein said elastic fabric sleeve comprises:

a first, outer layer; and a second, inner layer comprised of a wickings material; and wherein said first outer layer is planarly aligned with said second, inner layer.

2. The athletic helmet chin strap cover of claim 1, wherein said outer layer extends outward from sides of the inner layer and is wrapped about each such side by a hem and sealed by a seam.

3. The athletic helmet chin strap cover of claim 1, further comprising labeling means for affixing an athletic team logo.

4. The athletic helmet chin strap of claim 1, further comprising:

an outer surface having a smooth, linear first side opposite a parallel, smooth, linear second side and a concave lower protrusion extending downward from a main planar surface at a lower boundary in a symmetric, curvilinear manner having an upward arching lowermost point that smoothly transitions at each end to a horizontal extension at each of a side-most portions of a lower perimeter edge in a symmetric, curvilinear manner, having an upward arching lowermost point that smoothly transitions to horizontal at each end.

5. The athletic helmet chin strap cover of claim 1, wherein said outer layer is formed of a porous fabric material having sufficient elasticity to accommodate the stretching of the decorative cover over a chin strap.

* * * * *